US007294204B2

(12) United States Patent
Hong et al.

(10) Patent No.: US 7,294,204 B2
(45) Date of Patent: Nov. 13, 2007

(54) APPARATUS FOR PAINTING TRAFFIC MARKS ON ROAD SURFACE

(75) Inventors: Daehie Hong, Gaithersburg, MD (US); Jung Yup Kim, Seoul (KR); Hyun Ho Shin, Incheon (KR); Jae Bong Shin, Seoul (KR); Woo Chang Lee, Seoul (KR); In Ju Hwang, Paju (KR); Tae Hyung-Kim, Seoul (KR)

(73) Assignee: Korea Joongang Hak Wonco., Ltd, Seoul (KR)

( * ) Notice: Subject to any disclaimer, the term of this patent is extended or adjusted under 35 U.S.C. 154(b) by 0 days.

(21) Appl. No.: 10/962,864

(22) Filed: Oct. 8, 2004

(65) Prior Publication Data

US 2005/0081783 A1 Apr. 21, 2005

(30) Foreign Application Priority Data

Oct. 7, 2003 (KR) ..... 10-2003-0069712

(51) Int. Cl.
*B05B 9/06* (2006.01)
*B05C 11/00* (2006.01)

(52) U.S. Cl. ..... 118/323; 118/679; 118/697; 239/227; 404/84.05

(58) Field of Classification Search ..... 118/305, 118/695, 679, 712, 323, 697, 668, 698, 708; 239/227, 754; 404/84.05, 93, 94; 427/427.2, 427/427.3

See application file for complete search history.

(56) References Cited

U.S. PATENT DOCUMENTS 3,477,352 A 11/1969 Harding et al.
4,802,788 A 2/1989 Smith
4,856,931 A 8/1989 Bollag
4,973,819 A * 11/1990 Thatcher ..... 219/121.78
5,086,678 A * 2/1992 Aoyagi et al. ..... 83/13
5,114,268 A 5/1992 Marcato
5,169,262 A 12/1992 Wilson et al.
5,260,101 A * 11/1993 Larson et al. ..... 427/388.2
5,383,277 A * 1/1995 Shimoda et al. ..... 33/18.1
5,486,067 A 1/1996 Huynh
5,511,896 A 4/1996 Marcato
5,529,432 A * 6/1996 Huynh et al. ..... 404/84.05
5,561,242 A * 10/1996 Naumann et al. ..... 73/65.09
6,157,157 A * 12/2000 Prentice et al. ..... 318/625
6,358,344 B1 * 3/2002 Hunter, Jr. ..... 156/71
6,505,995 B2 1/2003 San Filippo et al.
6,719,467 B2 4/2004 Hess et al.
6,764,024 B2 * 7/2004 Crampton ..... 239/246

* cited by examiner

*Primary Examiner*—Yewebdar Tadesse
(74) *Attorney, Agent, or Firm*—Jennifer Meredith, Esq.; Meredith & Keyhani, PLLC

(57) ABSTRACT

An apparatus for painting traffic marks on a road surface without requiring any professional painting skills. The apparatus having: a first support and second support being parallel to each other and a coupling unit to couple the supports. There is also a gantry unit, having: at least one Y-axial gantry coupled to and being movable along the first and second support, and an X-axial gantry coupled to the Y-axial gantry to be movable in a direction perpendicular to the first support and second support. The apparatus further includes: a jet unit coupled to the X-axial gantry, with a jet nozzle to spray paint downwards; a feeding device, having a first feeding unit to move the Y-axial gantry and a second feeding unit to move the X-axial gantry. There may be a third feeding unit to move the jet unit. There is also a control unit to control operation of the apparatus.

5 Claims, 14 Drawing Sheets

APPARATUS FOR PAINTING TRAFFIC MARKS ON ROAD SURFACE

BACKGROUND OF THE INVENTION

The present invention relates generally to apparatuses for painting traffic marks on road surfaces and, more particularly, to an apparatus for painting traffic marks on road surfaces which is stable due to its three dimensional gantry system and more accurate due to an automatically operated by an input program. In this manner, the present invention allows a user to easily paint traffic marks on a road surface without professional skill for painting traffic marks.

Recently, there has been an increase in traffic volume as well as in the number of automobiles and kinds of traffic lines. Kinds of traffic lines may include yellow median lines to divide roads into two directions, white dotted lines to divide roads into several lanes, and blue lines for buses, etc., have been painted on road surfaces.

To paint such traffic lines on road surfaces, various traffic line painting apparatuses have been proposed. An example of a conventional traffic line painting apparatus is shown in FIG. 1 and FIG. 2. FIG. 1 depicts a sectional view showing a conventional apparatus 1 for painting traffic lines. FIG. 2 is a plan view of the conventional traffic line painting apparatus 1 of FIG. 1. As shown in FIGS. 1 and 2, the conventional traffic line painting apparatus 1 includes a jet nozzle control unit 10 for painting a traffic line, and a paint heating unit 30 which is integrally supported on a support frame 40 to heat paint to lower the viscosity of the paint to make it suitable for painting. Four wheels 51, 52, 53 and 54 are rotatably coupled to the support frame 40 or an outer casing 38 of the paint heating unit 30.

The support frame 40 includes a lower frame 43 having a long elliptical shape, and a handle frame 45. The paint heating unit 30 is mounted on the center of the lower frame 43. The jet nozzle control unit 10 is supported on a front end of the lower frame 43. The handle frame 45 extends from a rear part of the lower frame 43 rearwards and upwards, while a handle 47 is formed on an upper end of the lower frame 43.

The paint heating unit 30 has a burner 32 which is provided on a lower part of the paint heating unit 30 and uses a fuel, such as LPG, to be supplied from a gas tank 31. An oil tank 35, in which a thermal oil 34 is contained to heat the paint supplied from an outside painting carriage through a paint supply pipe 33, is provided above the burner 32.

The paint supply pipe 33 is coupled to an inlet of a heating pipe 36 which is coiled in the oil tank 35. An outlet of the heating pipe 36 is coupled to a lower end of the jet nozzle control unit 10. The oil tank 35 is installed in the outer casing 38 which collects and discharges combustion gas to the outside through an exhaust hole 37. Opposite curved parts 36*a* of the heating pipe 36 are exposed to the outside. The heating pipe 36 has a separable structure to facilitate repair when a breakdown occurs.

A thermometer 39 is provided on an upper part of the outer casing 38 to indicate the temperature of the thermal oil 34. A thermal air path unit 41, which communicates with the oil tank 35, protrudes outwards on the upper part of the outer casing 38.

The burner 32 burns LPG supplied from the gas tank 31 to heat the paint heating pipe 36. Thus, paint, supplied to the heating pipe 36 through the paint supply pipe 33, is heated to a temperature suitable for painting while passing through the heating pipe 36 in the oil tank 35.

Thereafter, the paint is supplied into the jet nozzle 25 via the jet nozzle control unit 10 and an active pipe 14. In this state, when a user pulls a control lever 49 provided on the handle 47, the jet nozzle 25 opens to spray the paint onto the road surface.

The conventional traffic line painting apparatus having the above-mentioned construction is suitable for painting linear and curvilinear lines. However, it is very difficult to paint various traffic guide marks on road surfaces for indicating various information to drivers, for example, letters, signs and pictures, etc. Thus, with the conventional traffic line painting apparatus, painting traffic marks depends on the painting skill of the user. Therefore, if the user is not a skilled expert, painting traffic guide marks may be impossible.

U.S. Pat. No. 5,114,268, as shown in FIG. 3, depicts another example of the prior art. The '268 patent discloses an apparatus for applying a traffic stripe. The apparatus includes a vehicle having a pair of front wheels and a pair of rear wheels and members, disposed on the vehicle, for steering the front wheels. There is a traffic stripe applying system, disposed outward of the front wheels and adjacent to one of the front wheels, for applying a traffic stripe to a road. A connector pivotally connects this applying system to the vehicle and defines an axis about which the applying system pivots relative to the vehicle. In addition, connected to the applying system, disposed forward of the pivot axis and acting in response to the steering of the front wheels, is a member or members for turning the applying system in the same direction as the front wheels when the front wheels are turned. The turning member or members may also turn the traffic stripe applying system at a greater angle than the front wheels when the front wheels are turned in a direction towards the applying system.

The prior art discussed is lacking in that the machine used to draw the markings typically paints under its center. As such, painting a center line requires two lanes of traffic to be tied up during the painting process. The present invention, solves this problem by providing an apparatus that allows the painting jet unit to extend one length of the apparatus from the center. In this manner, only one lane of traffic is required to be shut down during painting, as opposed to two lanes.

In each of the prior art embodiments, the act of painting traffic lines is manually executed, thus increasing the working time required for painting the traffic lines or marks. As well, conventional traffic line painting apparatus are problematic in that shapes and sizes of the painted traffic guide marks or lines may be uneven and subject to human error.

SUMMARY OF THE INVENTION

Accordingly, the present invention has been made keeping in mind the above problems occurring in the prior art, and an object of the present invention is to provide an apparatus for painting traffic marks on a road surface in which a jet nozzle is automatically controlled by an input program, thus allowing a user to easily paint desired traffic marks, such as traffic letters and patterns, on a road surface without professional skill for painting the traffic marks. Further, the present invention allows for off center painting to prevent shutting down two lanes of roadway to paint a middle line.

In order to accomplish the above object, the present invention provides an apparatus for painting traffic marks on a road surface, including: a trailer unit, having a pair of supports of a predetermined height and length, being parallel with each other, and a coupling unit to couple the supports to each other; a gantry unit, having at least one Y-axial gantry coupled to the pair of supports and being longitudinally movable along the pair of supports, and an X-axial gantry coupled to the Y-axial gantry to be movable in a direction perpendicular to the pair of supports; a jet unit coupled to a predetermined position of the X-axial gantry, with a jet nozzle provided on a predetermined portion of the jet unit to spray paint downwards; a feeding device, having a first feeding unit to move the Y-axial gantry, and a second feeding unit to move the X-axial gantry; and a control unit to control operation of the apparatus.

The Y-axial gantry may include first and second Y-axial gantries which are coupled at both ends thereof to the pair of supports to be parallel with each other and spaced apart from each other by a predetermined interval. The X-axial gantry may be coupled at both ends thereof to the first and second Y-axial gantries. The jet unit may be coupled to the X-axial gantry to be longitudinally movable along the X-axial gantry. The feeding device may further have a third feeding unit to move the jet unit.

The third feeding unit may include an X-axial belt longitudinally provided in the X-axial gantry and coupled at a predetermined portion thereof to the jet unit; and a first motor to rotate the X-axial belt.

The first feeding unit may include a rack longitudinally provided on a predetermined portion of the pair of supports; a pinion having a predetermined shape to engage with the rack; and a second motor, having a motor housing coupled to the Y-axial gantry, and an output shaft coupled to the pinion to rotate the pinion.

The second feeding unit may include a Y-axial belt longitudinally provided in the Y-axial gantry and coupled at a predetermined portion thereof to the X-axial gantry; and a third motor to rotate the Y-axial belt.

The jet unit may be coupled to the X-axial gantry to be longitudinally movable along the X-axial gantry. The jet unit may include a check valve to prevent backflow of paint; and a jet nozzle rotating unit to control a paint spraying angle of the jet nozzle.

The pair of supports may include two or more X-axial wheels to allow the pair of supports to move in an X-axial direction; and two or more Y-axial wheels to allow the pair of supports to move in a Y-axial direction. The pair of supports may further include an X-axial wheel rotating unit to rotate the X-axial wheels; and a Y-axial wheel rotating unit to rotate the Y-axial wheels. The control unit may control both the X-axial wheel rotating unit and the Y-axial wheel rotating unit, such that the X-axial wheels and the Y-axial wheels rotate independently.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
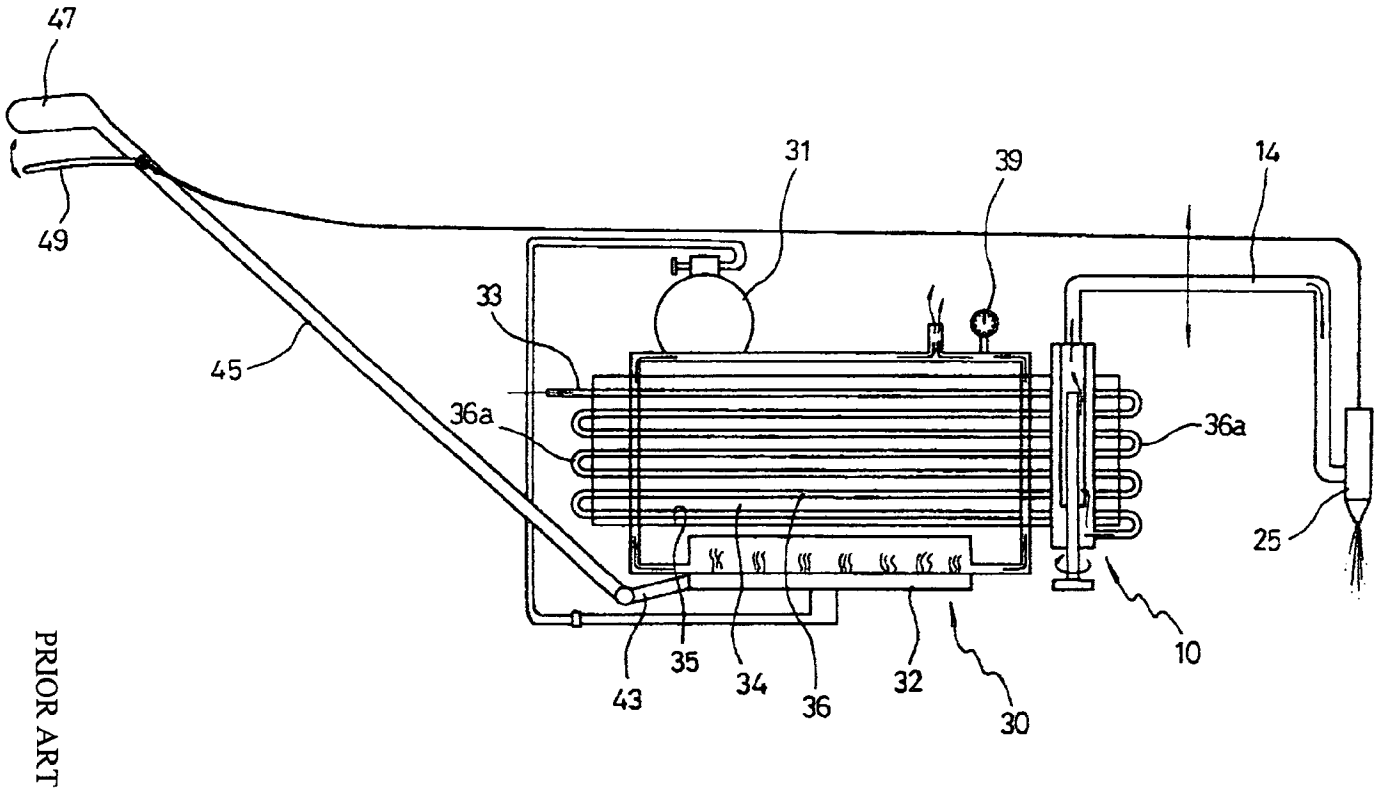
PRIOR ART Fig. 1
FIG. 1 is a sectional view showing a prior art apparatus for painting traffic lines.
Figure 2:
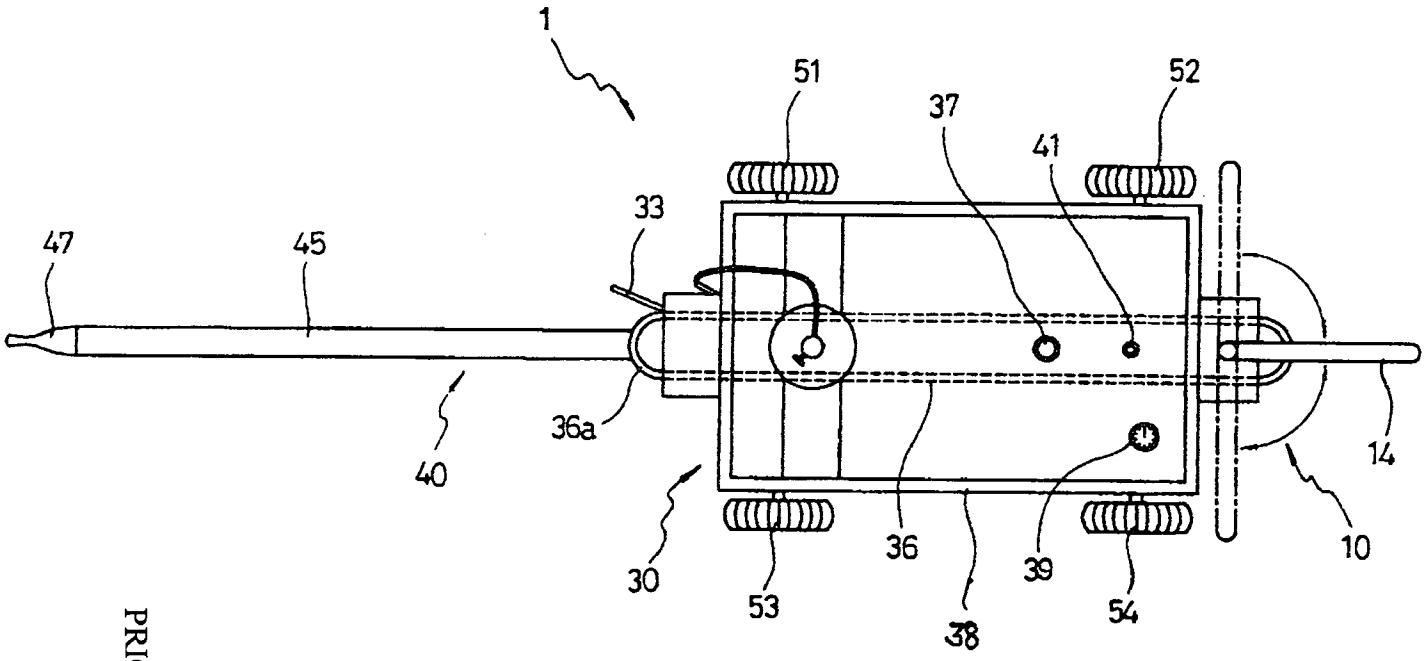
PRIOR ART Fig. 2
FIG. 2 is a plan view of the conventional apparatus of FIG. 1.
Figure 3:
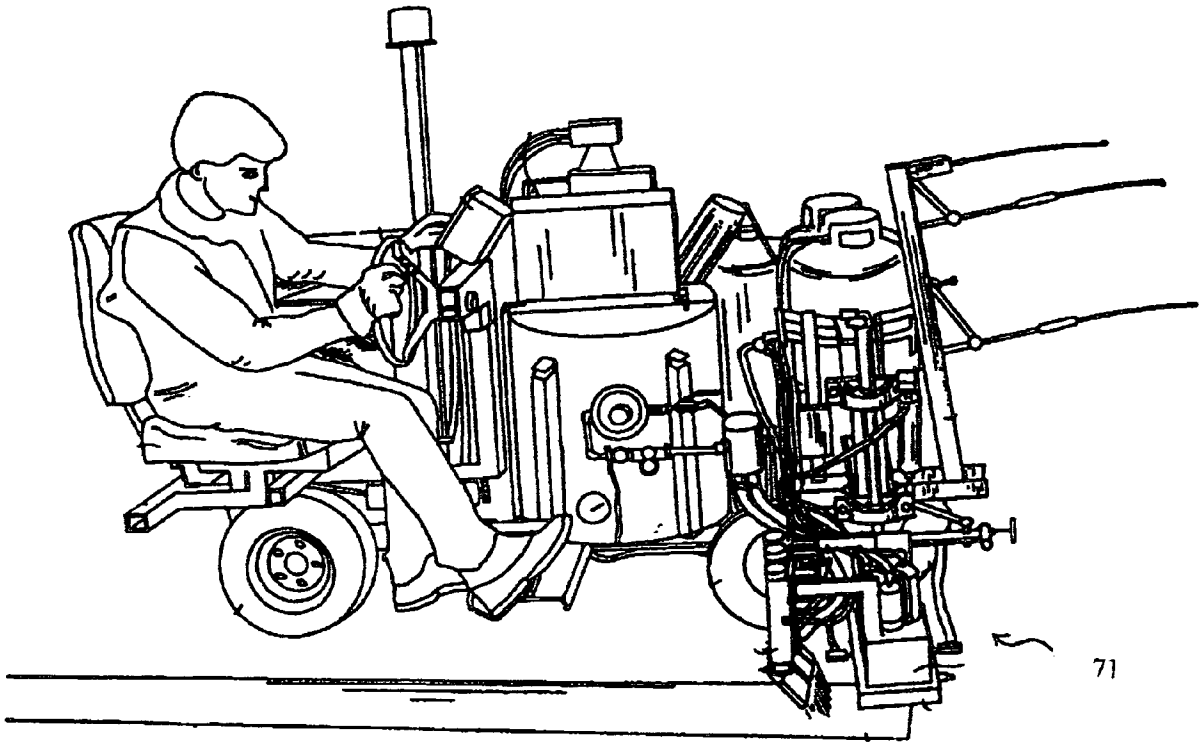
Fig. 3 PRIOR ART
FIG. 3 is a right side view of a prior art apparatus for painting traffic lines.

Reference now should be made to the drawings, in which the same reference numerals are used throughout the different drawings to designate the same or similar components.

Figure 4:
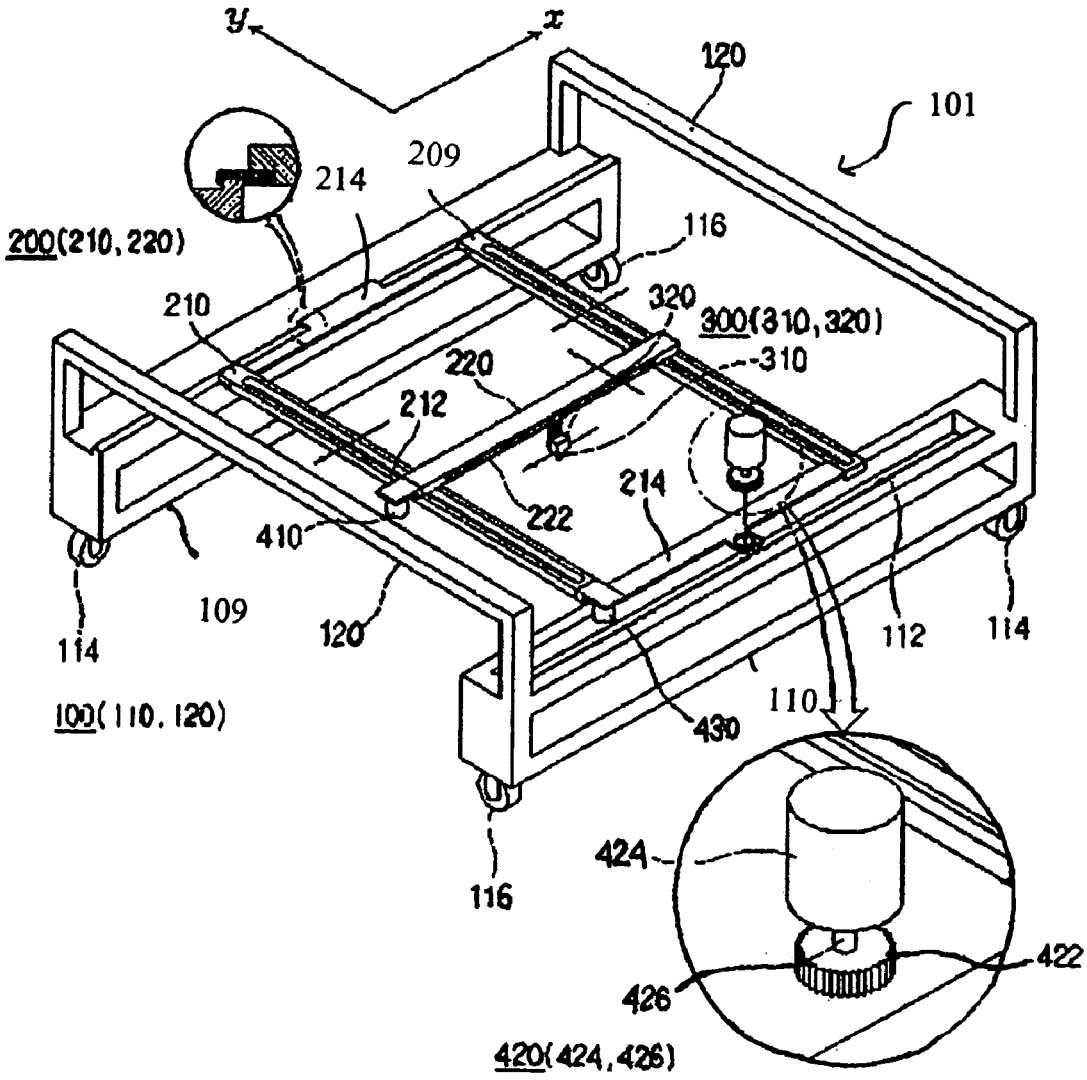
FIG. 4 is a perspective view of an apparatus for painting traffic marks on a road surface, according to the present invention.
Figure 5:
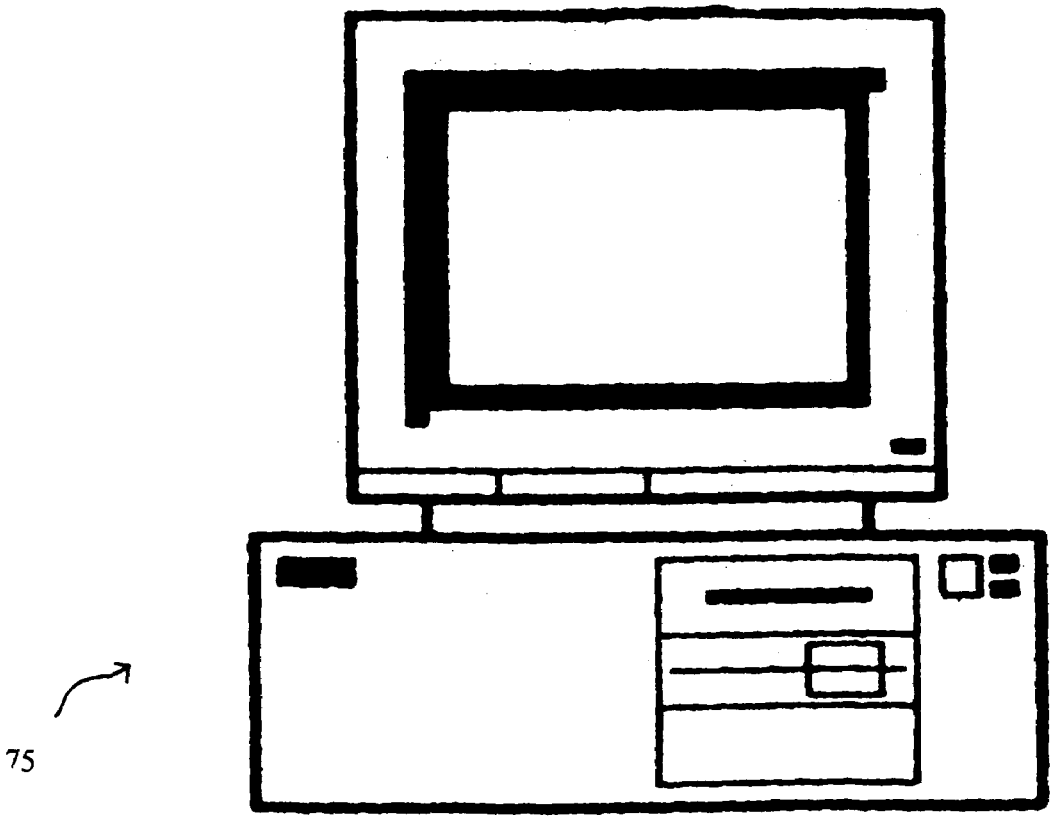
FIG. 5 is a plan view of a control unit.

FIG. 4 is a perspective view of an apparatus 101 for painting traffic marks on a road surface, according to the present invention. As shown, the traffic mark painting apparatus 101 of the present invention includes a trailer unit 100 which has a pair of supports, first support 109 and second support 110, each having a predetermined height and length. The first support 109 and second support 110 are placed to be parallel with each other. The trailer unit 100 further has a coupling unit 120 to couple the first support 109 to the second support 110. The traffic mark painting apparatus 101 further includes a gantry unit 200. The gantry unit 200 has at least one and preferably a pair of Y-axial gantries 210 which is coupled to the first support 109 and second support 110 and is longitudinally movable along the pair of supports is a direction substantially perpendicular to the supports. The Y-axial gantries 210 are coupled to each other by a pair of connecting rods 214. The gantry unit 200 further has an X-axial gantry 220 which is coupled to the Y-axial gantries (209, 210) to be longitudinally movable in a direction parallel to the pair of supports (109, 110). The traffic mark painting apparatus further includes a jet unit 300 which is coupled to the X-axial gantry 220 and moveable along the X-axial gantry. A jet nozzle 310 is provided on a predetermined portion of the jet unit 300 to spray paint downwards. The paint itself may rest upon the X-axial gantry 220 in a container or be in the vehicle. The jet nozzle 310 may also move in an up and down motion parallel to the X-axial gantry. The traffic mark painting apparatus further includes a feeding device. The feeding device includes a first feeding unit which has a first motor 420 to move the Y-axial gantries (209, 210), and a second feeding unit which has a second motor 430 to move the X-axial gantry 220. The feeding device further includes a third feeding unit which has a third motor 410 to move the jet unit 300. The traffic mark painting apparatus further includes a control unit to control the operation of the apparatus. FIG. 5 depicts one embodiment of a control unit. It is envisioned that the control unit may be any device that provides input to provide a set of instructions to effectuate the jet unit to emit paint according to the set of instructions. This may include a vehicle computer, laptop, palm pilot or the like.

The Y-axial gantry 210 has a Y-axial guide groove 212 which has a slot shape and longitudinally extends along the upper surface of the Y-axial gantry 210. The X-axial gantry 220 moves along the Y-axial guide grooves 212 in a state of being coupled to the Y-axial gantries (209, 210). The coupling of the X-axial gantry 220 to the Y-axial gantries 210 will be explained later herein, with reference to other drawings.

The X-axial gantry 220 has on a sidewall thereof an X-axial guide groove 222 which has a slot shape and longitudinally extends along the X-axial gantry 220. The jet unit 300 moves along the X-axial guide groove 222 in a state of being coupled to the X-axial gantry 220. The structure coupling the jet unit 300 to the X-axial gantry 220 is the same as the structure coupling the X-axial gantry 220 to the Y-axial gantries 210.

The jet unit 300 includes the jet nozzle 310 which is coupled to the X-axial gantry 220 to be vertically movable for height adjustment. The jet nozzle 310 spays paint downwards onto the surface. The jet unit 300 further includes a check valve to prevent the backflow of paint, and a gear box 320 which has a jet nozzle rotating unit to rotate the jet nozzle 310.

Typical jet nozzles for spraying paint, which have been used in conventional traffic mark painting apparatuses, linearly spray paints. Therefore, in conventional traffic line painting apparatuses, when it is desirable to change a painting direction while painting traffic marks, the traffic line painting apparatus must be steered according to the painting direction, or a jet nozzle must be manually rotated. However, in the traffic mark painting apparatus of the present invention, the jet nozzle 310 can be automatically rotated according to the painting direction, thus being more convenient to a user.

The general construction and operation of the check valve and the jet nozzle rotating unit of the present invention are the same as those of typical check valves and jet nozzles, respectively, thus further explanation is deemed unnecessary.

The pair of supports (first support 109 and second support 110) may include two X-axial wheels 114 to allow the pair of supports (first support 109 and second support 110) to move in an X-axial direction, and two Y-axial wheels 116 to allow the pair of supports (first support 109 and second support 110) to move in a Y-axial direction. The present invention may be attached to the underside of a car or truck or attached as a trailer to a car or truck. If the apparatus is attached to the underside of a car, it is not necessary that there be wheels, although it may be desirable. If it is a attached as a trailer, wheels are required. Preferably, the two X-axial wheels 114 are placed on a diagonal line of the pair of supports (first support 109 and second support 110) and the two Y-axial wheels 116 are placed on another diagonal line of the pair of supports (first support 109 and second support 110), thus allowing the pair of supports (first support 109 and second support 110) to be movable in a wide direction. Additionally, monitoring units, such as encoders, may be mounted to one or all of the X-axial wheels 114 and the Y-axial wheels 116 to monitor the moving distance and the location of the pair of supports (first support 109 and second support 110). Various kinds of location and distance monitoring units may be adapted to be used in the present invention. The traffic mark may also be monitored and fixed accordingly. For example, the traffic mark may be the word "STOP." The traffic mark, as painted, may be monitored and it may be determined that the "T" is not accurate as the paint is too light. As such, the control unit may provide a set of instructions to re-paint, or paint over, the letter. In this manner, the apparatus is accurate and self-fixing in the event of inaccuracy.

The control unit controls both the X-axial wheel rotating unit and the Y-axial wheel rotating unit, such that the X-axial wheels 114 and the Y-axial wheels 116 are independently operated. Therefore, when only the X-axial wheels 114 rotate, the traffic mark painting apparatus of the present invention moves in the X-axial direction. When only the Y-axial wheels 116 rotate, the traffic mark painting apparatus moves in the Y-axial direction. When the X-axial wheels 114 and the Y-axial wheels 116 rotate simultaneously, the traffic mark painting apparatus moves in a diagonal or curvilinear direction according to a rotation ratio between the X-axial wheels 114 and the Y-axial wheels 116.

The first feeding unit includes a rack 112 which is longitudinally provided on a predetermined portion of the pair of supports (first support 109 and second support 110), and a pinion 422 which has a predetermined shape to engage with the rack 112. The first motor 420 constituting the first feeding unit has a motor housing 424 which is coupled to one of the pair of connecting rods 214, and an output shaft 426 which is coupled to the pinion 422. When the first motor 420 is operated, the pinion 422, which engages with the output shaft 426 of the first motor 420, rotates. At this time, because the pair of supports (first support 109 and second support 110) having the rack 112 is maintained at a predetermined position on the surface, the pinion 422 longitudinally moves along the rack 112. As a result, the Y-axial gantries 210 longitudinally move along the rack 112 along with the pair of connecting rods 214 which is coupled to the motor housing 424.

The user can paint predetermined marks on a road surface using the traffic mark painting apparatus of the present invention by manipulating the control unit. Alternatively, the traffic mark painting apparatus may paint predetermined marks, such as traffic letters or patterns, on the road surface according to programs input into the control unit. In the case that the traffic mark painting apparatus executes a painting action under programs input into the control unit, the traffic mark painting apparatus is first turned on and, thereafter, desired programs are input into the control unit. Then, all painting actions are automatically executed, thus being convenient to the user. In addition, the desired elaborate marks, such as traffic letters or patterns, are painted on the road surface.

Figure 6:
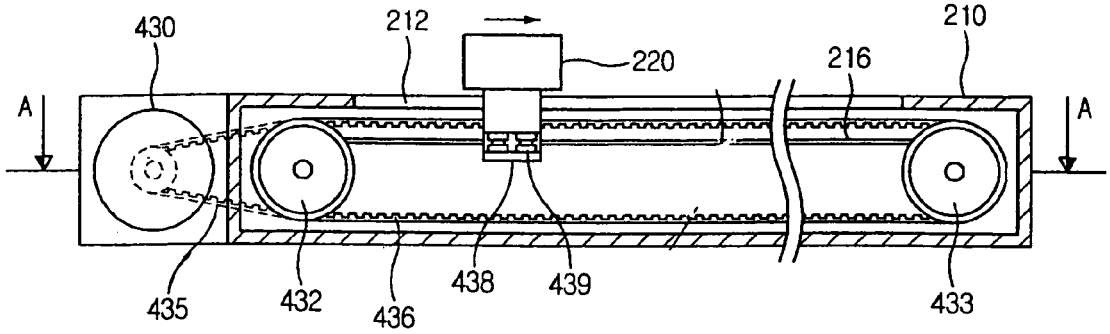
FIG. 6 illustrates a coupling of an X-axial gantry to a pair of Y-axial gantries of the apparatus of FIG. 4.
Figure 7:
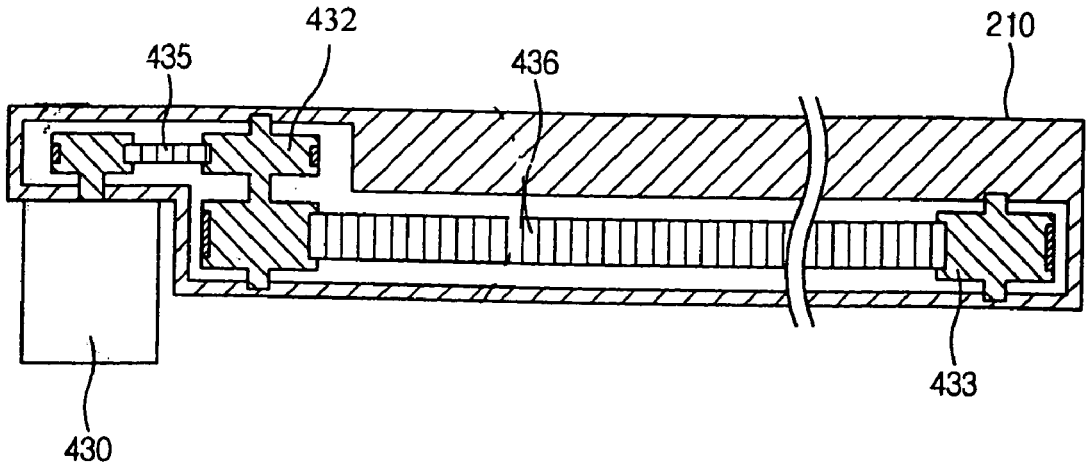
FIG. 7 is a sectional view taken along the line A-A of FIG. 6.

FIG. 6 illustrates a coupling of the X-axial gantry 220 to the Y-axial gantries 210. FIG. 7 is a sectional view taken along the line A-A of FIG. 6.

As shown in FIGS. 6 and 7, first and second pulleys (432, 433) are provided at both ends of one of the Y-axial gantries 210. An output shaft of the second motor 430, provided on the Y-axial gantry 210, is coupled to the first pulley 432 by a motor belt 435. The first and second pulleys 432 and 433 are coupled to each other by a Y-axial belt 436.

A connecting unit 438 is provided at a predetermined position of the Y-axial belt 436 which is placed in the Y-axial gantry 210 having the Y-axial guide groove 212. A part of the connecting unit 438 is exposed to the outside through the Y-axial guide groove 212. The X-axial gantry 220 is coupled to an exposed part of the connecting unit 438.

When the second motor 430 is operated, the first pulley 432 is rotated by the motor belt 435 coupled to the second motor 430. By the rotation of the first pulley 432, the Y-axial belt 436, which engages with the first and second pulleys 432 and 433, is driven. Thus, the connecting unit 438, coupled to the Y-axial belt 436, longitudinally moves along the Y-axial gantry 210. As a result, the X-axial gantry 220, coupled to the connecting unit 438, longitudinally moves along the Y-axial gantry 210 in a perpendicular direction.

A guide rail 216 is longitudinally provided on a predetermined portion of an inner sidewall of the Y-axial gantry 210 corresponding to a track of the connecting unit 438. A guide roller 439 is provided in a predetermined portion of the connecting unit 438 corresponding to the guide rail 216 to roll along the guide rail 216 in a state of being engaged with the guide rail 216. Accordingly, the connecting part is maintained in a level state without sagging due to the weight of the X-axial gantry 220.

The coupling of the jet unit 300 to the X-axial gantry 220 is the same as the coupling of the X-axial gantry 220 to the Y-axial gantry 210, thus further explanation is deemed unnecessary. It is, however, worth noting that the present invention provides three degrees of rotation (the X-axial gantry, Y-axial gantry and the jet unit). Because of this, the apparatus is highly accurate and provides detailed traffic marks with very low error rate.

Figure 8:
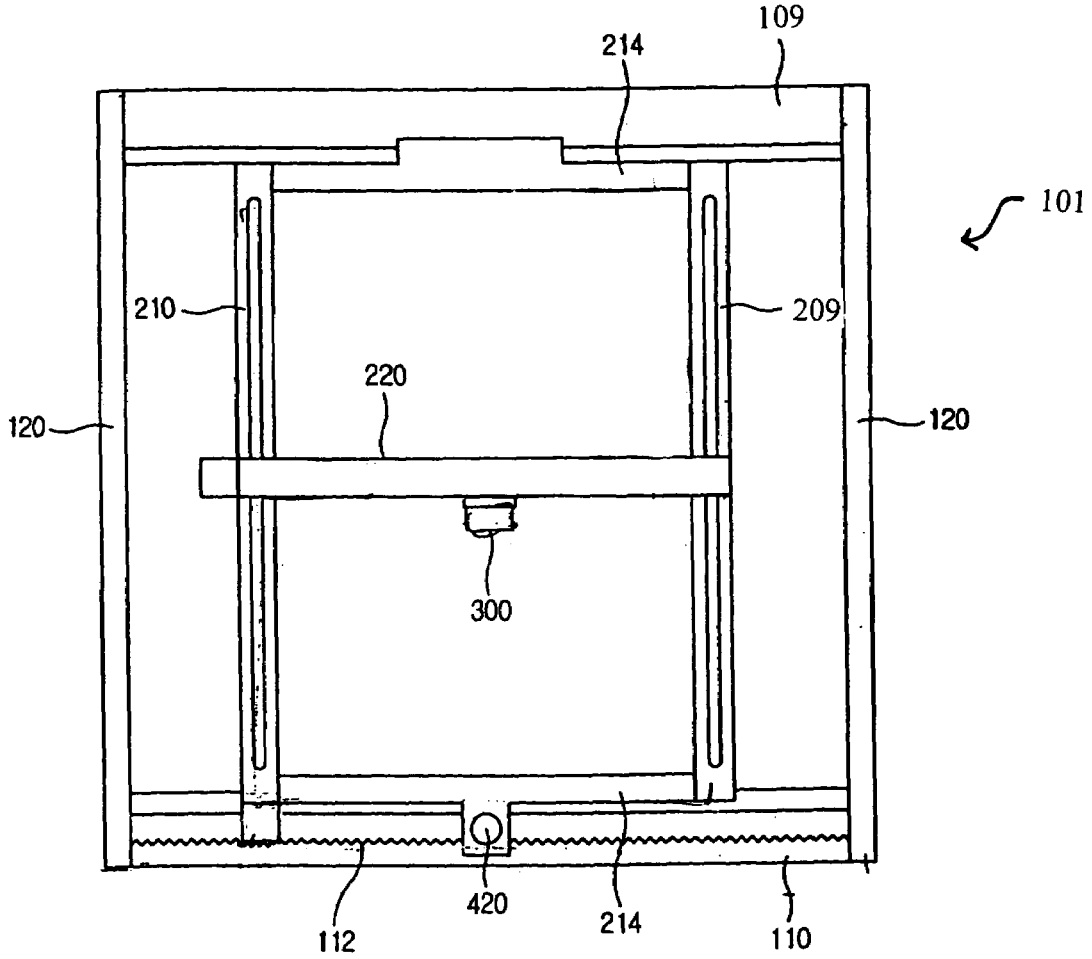
FIG. 8 is a plan view of the apparatus of FIG. 4.
Figure 9:
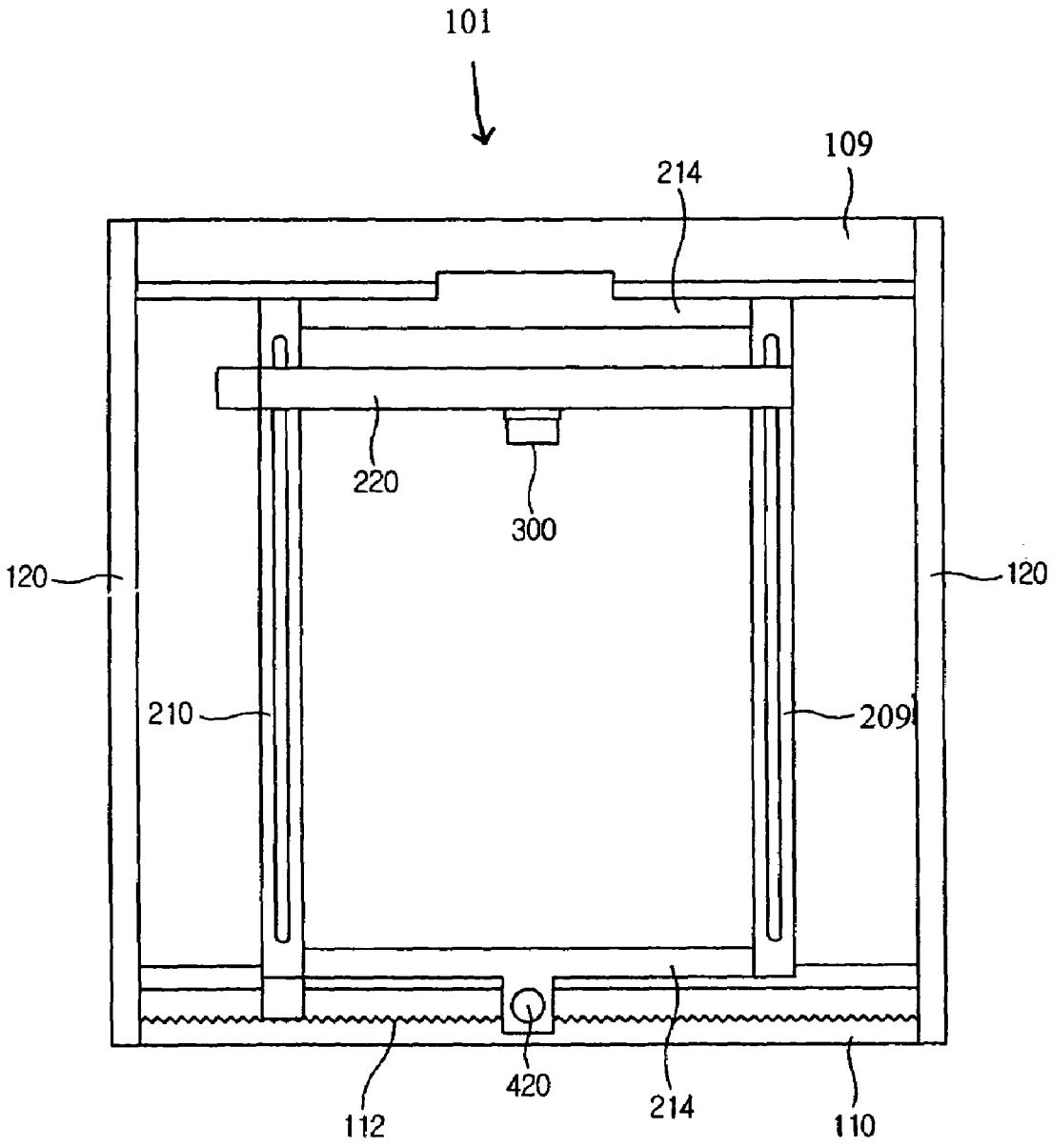
FIG. 9 is a plan view of the apparatus of FIG. 4 to show the X-axial gantry moved to first ends of the Y-axial gantries from the state shown in FIG. 8.

FIG. 8 is a plan view of the traffic mark painting apparatus of the present invention. FIG. 9 shows the X-axial gantry 220 moved to a first end of the Y-axial gantries 210 from the state shown in FIG. 8. The first end of the Y-axial gantries 210 is closest to first support 109.

As depicted in FIG. 9, if the second motor 430 is rotated in a predetermined direction, the X-axial gantry 220 moves towards the first ends of the Y-axial gantries 210. Thus, the jet unit 300 coupled to the X-axial gantry 220 also moves along with the X-axial gantry 220 towards the first ends of the Y-axial gantries 210. It should be understood that the jet unit 300 would typically be directed downwards to paint on the surface underneath the apparatus.

At this time, the X-axial gantry 220 can move until the jet unit 300 comes into contact with the support 110 which is placed around the first ends of the Y-axial gantries 210.

Figure 10:
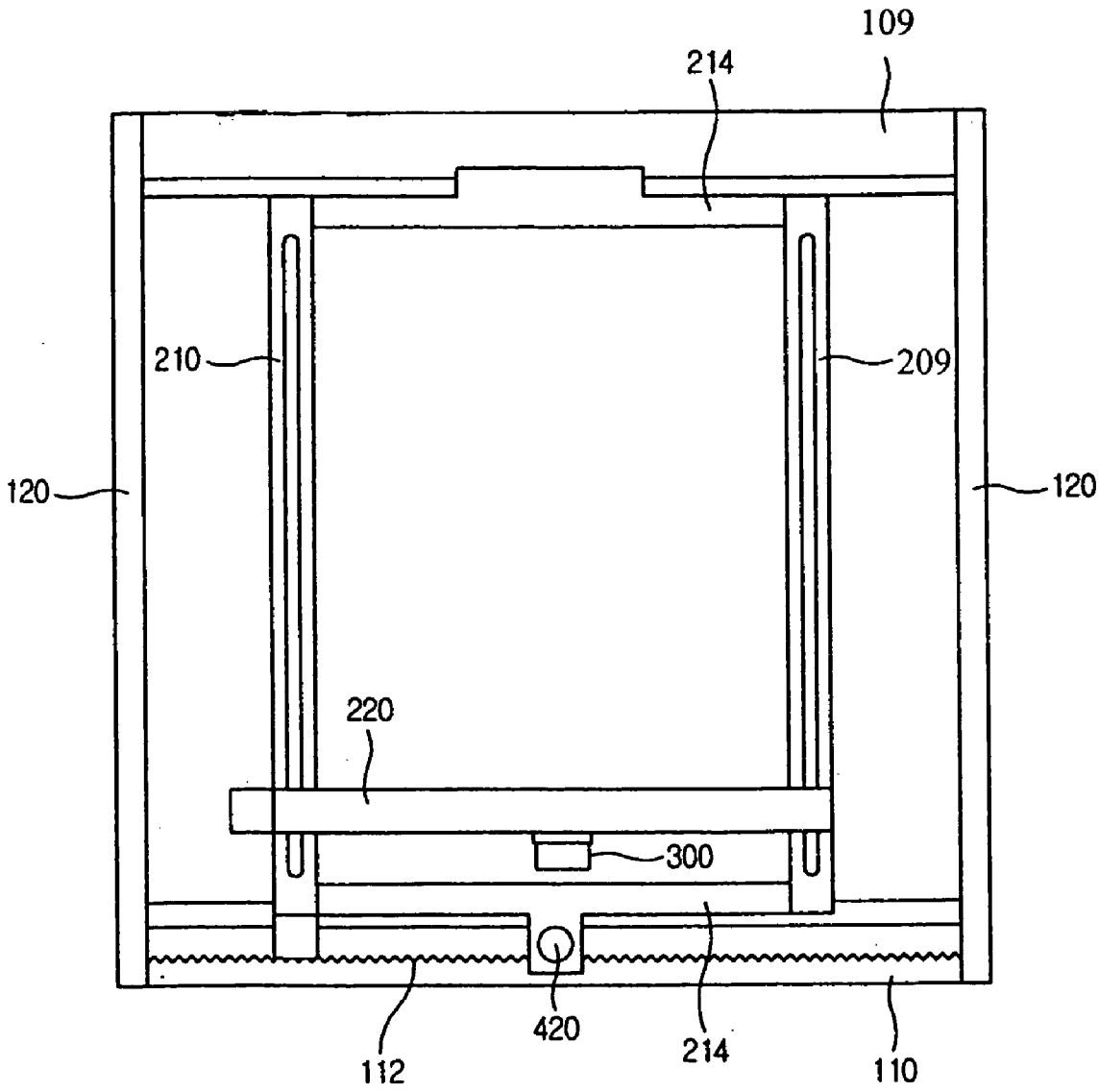
FIG. 10 is a plan view of the apparatus of FIG. 4 to show the X-axial gantry moved to second ends of the Y-axial gantries from the state shown in FIG. 8.

FIG. 10 shows the X-axial gantry 220 moved to second ends of the Y-axial gantries 210 from the state of FIG. 8.

In the state of FIG. 8, if the second motor 430 rotates in a direction opposite to the case of FIG. 9, the X-axial gantry 220 moves towards the second ends of the Y-axial gantries 210. Thus, the jet unit 300 coupled to the X-axial gantry 220 also moves along with the X-axial gantry 220 towards the second ends of the Y-axial gantries 210.

At this time, the X-axial gantry 220 can move until the jet unit 300 comes into contact with the other support 110 which is placed around the second ends of the Y-axial gantries 210. Therefore, the jet unit 300 can spray paint on any road surface which is between the pair of supports (first support 109 and second support 110).

Figure 11:
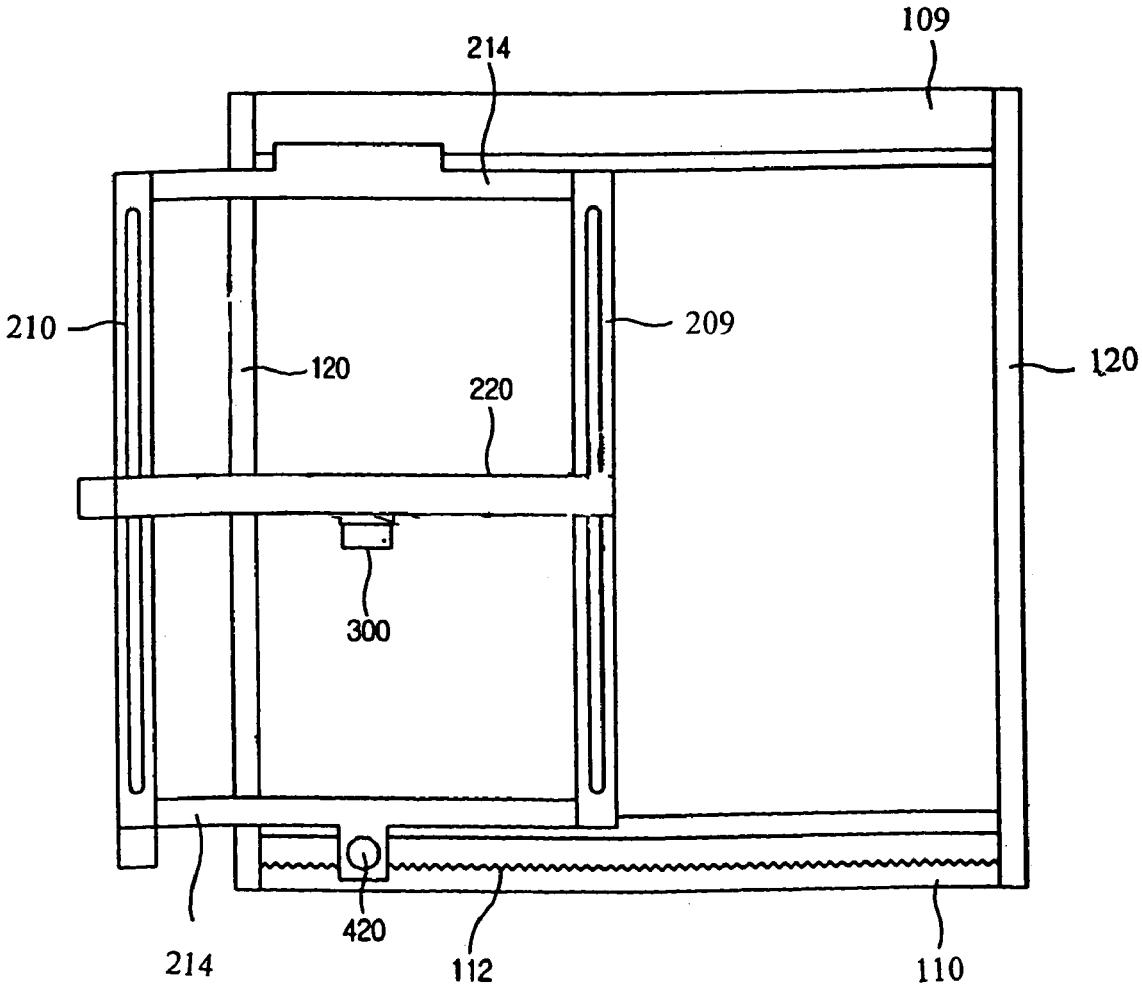
FIG. 11 is a plan view of the apparatus of FIG. 4 to show the Y-axial gantries moved to first ends of a pair of supports from the state shown in FIG. 8.

FIG. 11 shows the Y-axial gantries 210 moved to first ends of the pair of supports (first support 109 and second support 110) from the state shown in FIG. 8.

In the state shown in FIG. 8, when the first motor 420 rotates counterclockwise, the gantry unit 200 moves towards the first ends of the supports 110. The jet unit 300 coupled to the X-axial gantry 220 of the gantry unit 200 also moves along with the X-axial gantry 220 towards the first ends of the supports 110.

At this time, the gantry unit 200 can move until the pinion 422 of the first motor 420 is placed on a first end of the rack 112 as shown in FIG. 11.

Figure 12:
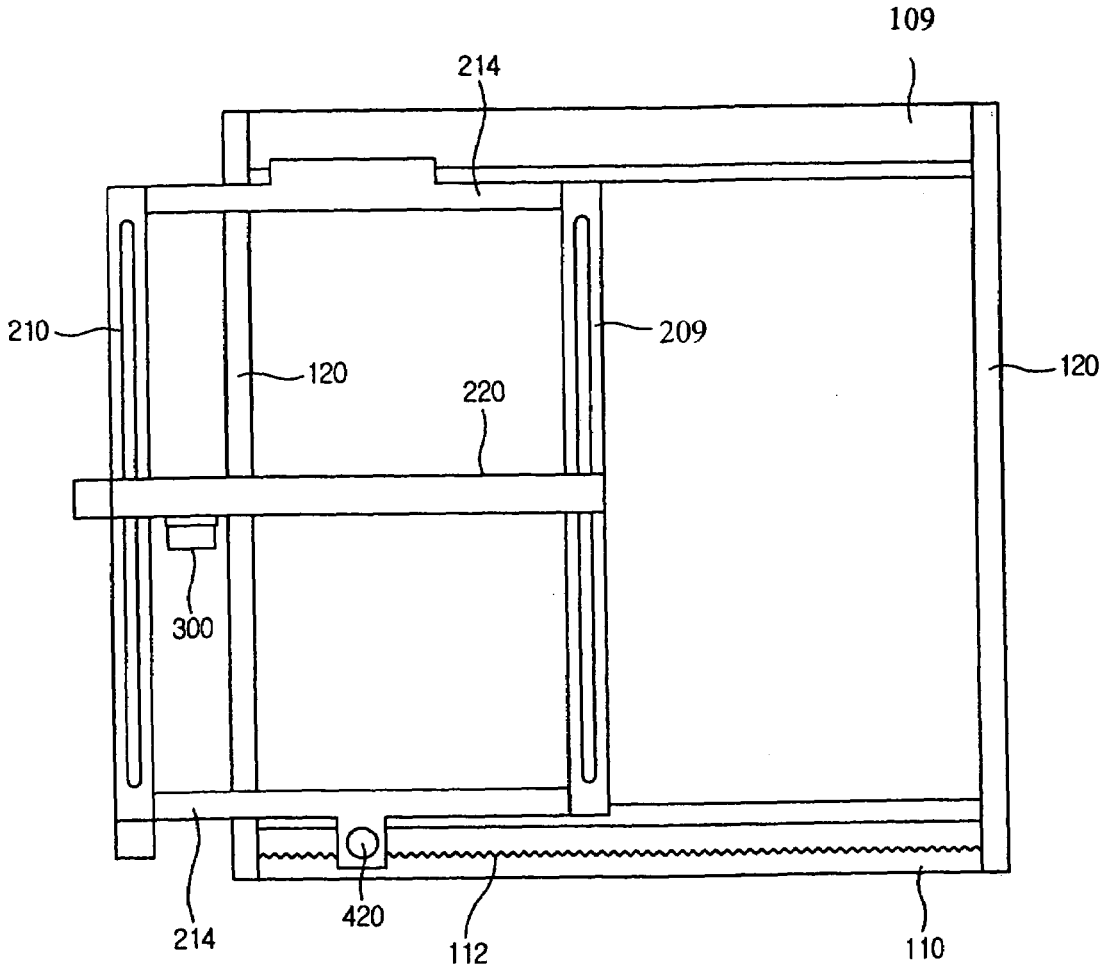
FIG. 12 is a plan view of the apparatus of FIG. 4 to show a jet unit moved along the X-axial gantry to a first end of the X-axial gantry from the state shown in FIG. 12.

FIG. 12 shows the jet unit 300 moved on the X-axial gantry 220 to a first end of the X-axial gantry 220 from the state shown in FIG. 11.

When it is desirable to paint a predetermined portion outside the coupling unit 120 which is provided on the first ends of the supports 110, the third motor 410 is rotated in a predetermined direction. Then, the jet unit 300 moves towards the first end of the X-axial gantry 220. As shown in FIG. 12, the jet unit 300 may be placed outside the coupling unit 120 which is provided on the first ends of the supports 110.

At this time, a range of the movement of the jet unit 300 is limited between the pair of Y-axial gantries 210. Therefore, as the distance between the pair of Y-axial gantries 210 increases, the range of the movement of the jet unit 300 becomes wider.

Figure 13:
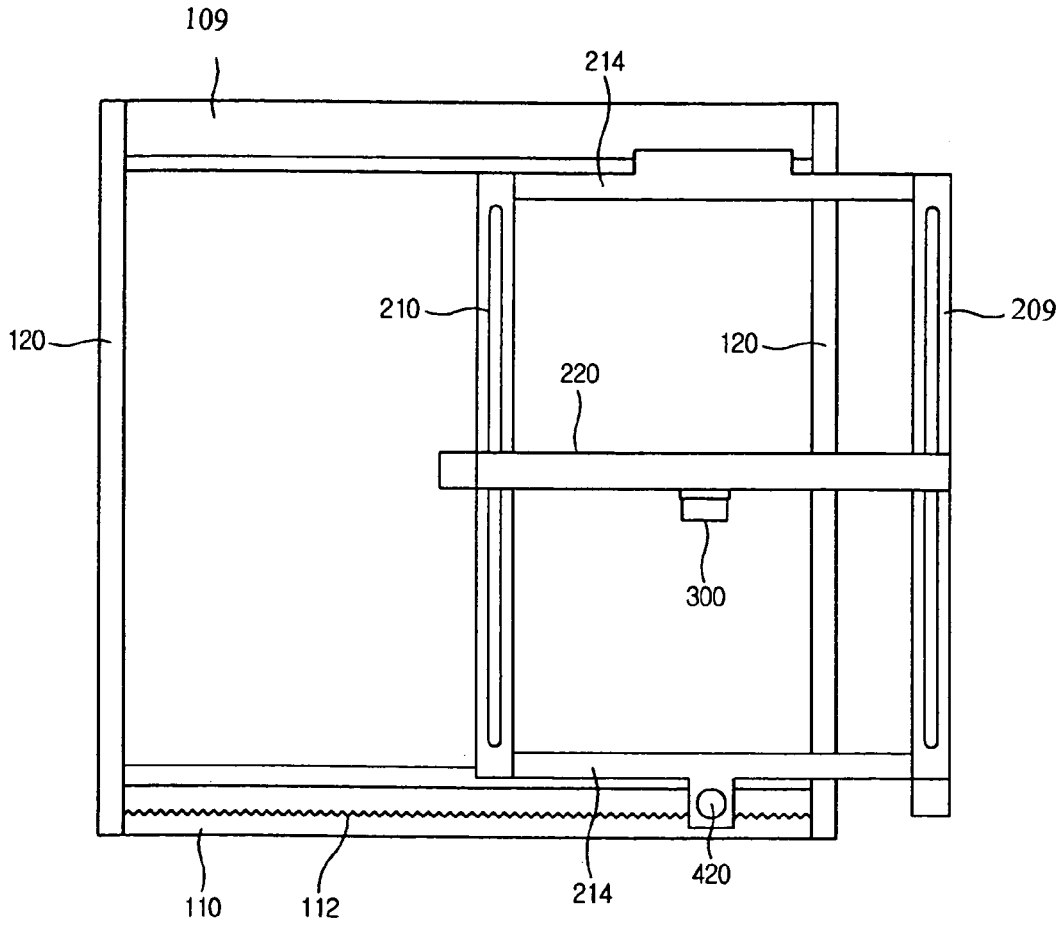
FIG. 13 is a plan view of the apparatus of FIG. 4 to show the Y-axial gantries moved to second ends of the supports from the state shown in FIG. 8.

FIG. 13 shows the Y-axial gantries 210 moved to second ends of the supports 110 from the state shown in FIG. 8.

In the state of FIG. 8, when the first motor 420 rotates clockwise, the gantry unit 200 moves towards the second ends of the supports 110. The jet unit 300 coupled to the X-axial gantry 220 of the gantry unit 200 also moves along with the X-axial gantry 220 towards the second ends of the supports 110.

At this time, the gantry unit 200 can move until the pinion 422 of the first motor 420 is placed on a second end of the rack 112 as shown in FIG. 13.

Figure 14:
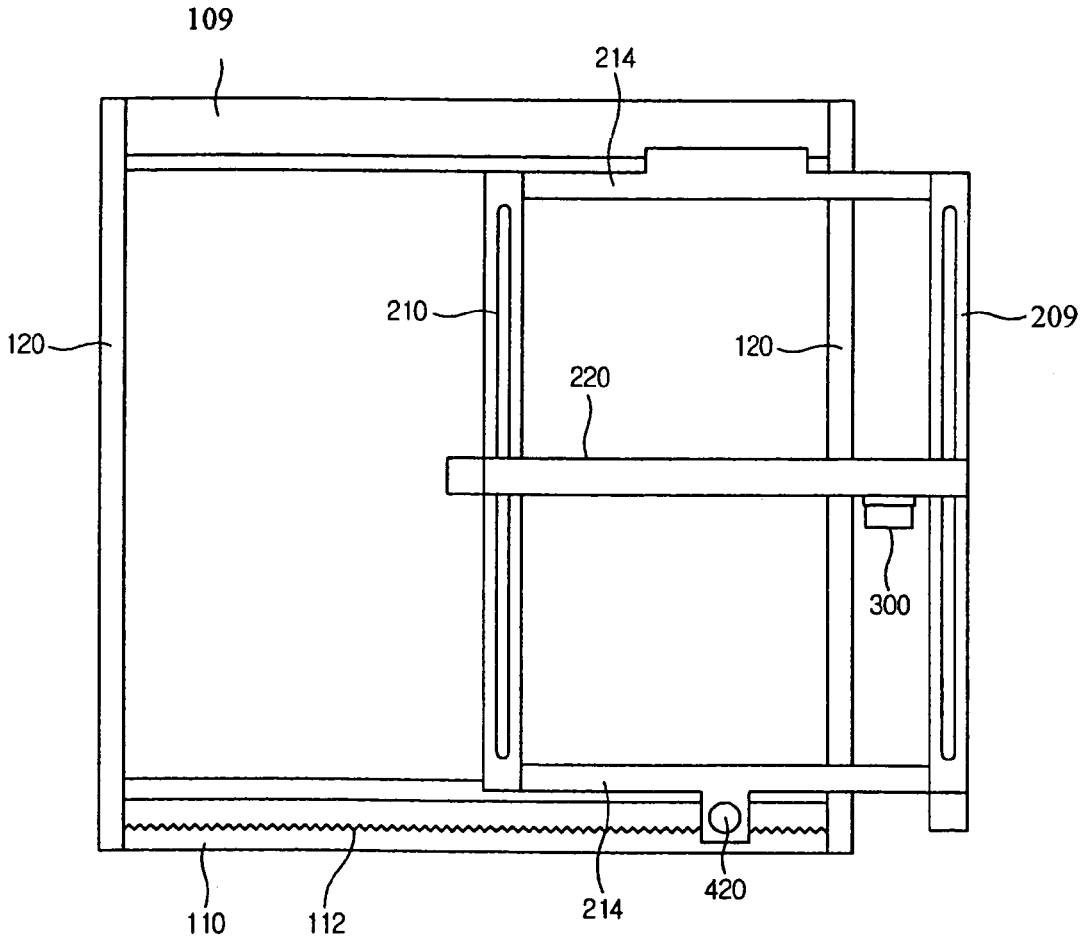
FIG. 14 is a plan view of the apparatus of FIG. 4 to show a jet unit moved along the X-axial gantry to a second end of the X-axial gantry from the state shown in FIG. 13.

FIG. 14 shows the jet unit 300 moved on the X-axial gantry 220 to a second end of the X-axial gantry 220 from the state of FIG. 13.

When the third motor 410 rotates in a direction opposite to the case of the FIG. 12, the jet unit 300 moves towards the second end of the X-axial gantry 220.

As such, due to the movement of the jet unit 300, the painting range of the traffic mark painting apparatus is not limited to the trailer unit 100 area, but becomes wider.

A method of applying paint to a surface is also disclosed and claimed herein. The method comprising the steps of: providing an apparatus for painting traffic marks on a road surface, the apparatus comprising: a first support and a second support being parallel; a gantry unit coupled to the first support and the second support and having at least one X-axial gantry and at least one Y-axial gantry; a jet unit coupled to the X-axial gantry, the jet unit having a jet nozzle to spray paint downwards; a feeding device, comprising: a first feeding unit to move the Y-axial gantry; and a second feeding unit to move the X-axial gantry; and a control unit to control operation of the apparatus; inputting a traffic marking request into the control unit, wherein the control unit determines a set of instructions that move the X-axial gantry, the Y-axial gantry and the jet unit to provide a traffic marking; and performing the set of instructions to emit paint from the jet unit to paint a traffic marking. The method of applying paint to a surface may further comprise the steps of monitoring the apparatus; determining whether the traffic marking is accurate; and adjusting the X-axial gantry, the Y-axial gantry and the jet unit to provide an accurate traffic marking. This process may be iterative, that it may repeatedly determine whether the traffic marking is accurate and adjusting the X-axial gantry, Y-axial gantry and the jet unit accordingly.

As described above, the present invention provides an apparatus for painting traffic marks on a road surface which paints various traffic marks, such as traffic letters and patterns, on the road surface according to an input program, so that, although a user is not a traffic mark painting expert, the user can easily and simply paint desired traffic marks, such as traffic letters and patterns, on the road surface.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for painting traffic marks on a road surface, said apparatus comprising:

a trailer unit, comprising a first support and a second support being parallel to each other; and at least one coupling unit to couple said first support to said second support;

a gantry unit, comprising:

a first Y-axial gantry and a second Y-axial gantry coupled at both ends to said first support and said second support to be parallel with each other, wherein said first X-axial gantry and said second Y-axial gantry each have a Y-axial guide groove and move longitudinally in a direction substantially perpendicular to said first support and said second support;

a first connecting rod and a second connecting rod, said first connecting rod coupling a first end of said first Y-axial gantry to a first end of said second Y-axial gantry and a second connecting rod coupling a second end of said first Y-axial gantry to a second end of said second Y-axial gantry; and at least one X-axial gantry having an X-axial guide groove, wherein said X-axial gantry is coupled to said first Y-axial gantry and said second Y-axial gantry to be longitudinally movable in a direction substantially parallel to said first support and said second support along said Y-axial guide groove;

a jet unit coupled to said X-axial gantry to be longitudinally movable along said X-axial guide groove, said jet unit having a jet nozzle, a check valve and a jet nozzle rotating unit;

a feeding device, comprising:

a first feeding unit to move the Y-axial gantry, said first feeding unit comprising:

a rack longitudinally provided on said first support and said second support; a pinion to engage said rack; and a first motor having a motor housing coupled to said Y-axial gantry and an output shaft coupled to said pinion to rotate said pinion;

a second feeding unit to move the X-axial gantry, said second feeding unit comprising:

a Y-axial belt longitudinally provided in said Y-axial gantry;

a second motor to rotate said Y-axial belt; and a connecting unit coupled to said Y-axial belt and said X-axial gantry for coupling said Y-axial gantry to said X-axial gantry;

a third feeding unit to move said jet unit, said third feeding unit comprising:

an X-axial belt longitudinally provided in said X-axial gantry and coupled to said jet unit;

a third motor to rotate said X-axial belt;

a control unit to control operation of said feeding device and operation of said jet unit; and at least two X-axial wheels and at least two Y-axial wheels placed on a diagonal line of said first support and said second support.

2. The apparatus as in claim 1, further comprising a first pulley and second pulley coupled to each other by said Y-axial belt, wherein said first pulley is rotated by said second motor and rotates said second pulley and said connecting unit, thereby moving said X-axial gantry along said Y-axial gantry.

3. The apparatus as in claim 1, further comprising:

an X-axial wheel rotating unit to rotate said at least two X-axial wheels; and an Y-axial wheel rotating unit to rotate said at least two Y-axial wheels, wherein said control unit independently controls said X-axial wheel rotating unit and said Y-axial wheel rotating unit.

4. An apparatus as in claim 3, further comprising at least one monitoring unit mounted to said at least one X-axial wheel and at least one monitoring unit mounted to said at least one Y-axial wheel.

5. An apparatus as in claim 1, wherein said jet unit is further comprised of a gear box.

* * * * *